United States Patent [19]

Tucker

[11] 4,337,871

[45] Jul. 6, 1982

[54] CROWN CLOSURE

[75] Inventor: Raymond L. Tucker, Broadbeach, Australia

[73] Assignee: Mauri Brothers & Thomson (Aust.) Pty. Limited, New South Wales, Australia

[21] Appl. No.: 186,600

[22] Filed: Sep. 12, 1980

[30] Foreign Application Priority Data

Sep. 20, 1979 [AU] Australia ..... PE0595

[51] Int. Cl.[3] ..... B65D 41/12

[52] U.S. Cl. ..... 215/328

[58] Field of Search ..... 215/328

[56] References Cited

U.S. PATENT DOCUMENTS

| | | | |
|---|---|---|---|
| 1,722,587 | 7/1929 | McDonnell | 215/328 |
| 2,497,870 | 2/1950 | Dennis | 215/328 |
| 3,092,280 | 6/1963 | Ford | 215/328 |
| 3,147,875 | 9/1964 | Rutledge | 215/328 |
| 3,171,560 | 3/1965 | Desch | 215/328 |
| 3,291,332 | 12/1966 | Morris | 215/328 |

*Primary Examiner*—Donald F. Norton

*Attorney, Agent, or Firm*—Leblanc, Nolan, Shur & Nies

[57] ABSTRACT

A crown seal seal blank of the kind comprising a roof portion with a downwardly extending skirt having a flared and ribbed peripheral portion wherein each rib of said peripheral skirt portion is of substantially the same breadth throughout its length. Upon application to a bottle the blank forms a closure cap wherein each protruding rib has an elongated depression extending from the ribs free end.

3 Claims, 11 Drawing Figures

CROWN CLOSURE

FIELD OF THE INVENTION

This invention relates to crown seals as used for sealing the pouring openings of bottles.

BACKGROUND OF THE INVENTION

As is well known a conventional bottle opening is rimmed by a bead of slightly larger diameter than the neck of the bottle immediately below it and a crown seal comprises a metal cap which, in the finished, closed condition, has a skirt, portions of the lower margin of which are pressed under that bead to secure the cap in place. Usually the top of the cap has a resilient layer or annulus applied to its under surface to make hermetic contact with the top of the bottle.

In the industrial application of crown seals a blank is first prepared which is similar in many respects to the finished cap but with its skirt more flared than it is in the finished cap.

The skirt of the blank is corrugated or formed with spaced apart radially extending ribs in it. Those ribs usually decrease in depth towards their radially outer ends and also decrease in width in the same direction.

The blank is applied to the bottle by means of a forming tool which is basically cylindrical in shape and which is brought down so as to contact the flared skirt of the blank after the blank has been positioned on the top of the bottle. The forming tool bears against the aforesaid ribs, which because of their shape are relatively stiff and as the forming process continues those ribs are bent about the line of junction between the flared and unflared portions of the skirt so as to conform with the cylindrical inner surface of the tool, whilst the portions of the skirt intermediate each rib are caused to move under the bead and secure the cap tightly in place.

With prior known crown seals the finished ribbed skirt of the cap displays relatively sharply edged protruberances and it is uncomfortable or maybe even painful if it is grasped tightly in the hand, for example, in the crotch between the thumb and first finger.

This is a problem of some magnitude in the case of relatively newly developed twist-off crown seals. In such seals, the finish of the bottle is formed with a multi-start thread superimposed on the rim bead and the skirt of the cap is pressed about that thread formation during the application of the blank to the bottle. Thus, if the cap is subsequently turned by hand the effect of the thread formation is to expand the skirt and at the same time force the cap upwardly off the bottle. This necessitates a tight gripping of the cap and consequent discomfort is apt to occur.

BRIEF DESCRIPTION OF THE INVENTION

An object of the present invention is to ameliorate the above indicated disability in prior known crown seals by very simple means.

According to the invention the ribs formed in the skirt of the blank of a crown seal cap are of substantially the same depth throughout their length and are broader at their radially outer ends than has been the case hitherto. Thus each rib ends in a more or less arcuate relatively long peripheral edge.

Therefore, when the forming tool is applied to the cap blank the consequent reduction in the length of the periphery of the skirt is accommodated in part by a collapse and subsequent infolding of the peripheral marginal portion of each rib. As a result, the ribs which in a finished conventional crown seal have the form of substantially vertical, radially projecting, sharply peaked ribs have, in a seal according to the invention, an end which is depressed or folded inwardly so that the rib is bifurcated at its lower edge. In effect therefore the ribs are shallower in the case of a seal according to the invention by comparison with those of prior known seals and at the point of maximum radial projection there are vertually twice as many ribs offering twice as many points of contact with the hand. The net result of these modifications is to produce a seal cap which is appreciably more comfortable when grasped and turned.

DETAILED DESCRIPTION OF THE PREFERRED EMBODIMENT

Figure 1:
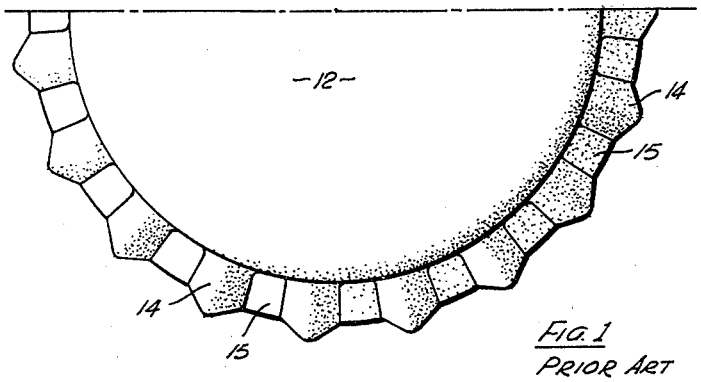
FIG. 1 PRIOR ART
FIG. 1 is of an enlarged plan view of half of a crown seal cap blank in accordance with the prior art.
Figure 2:
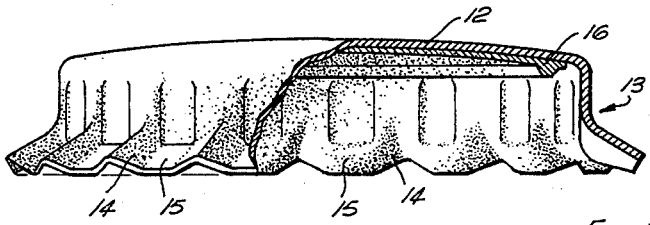
FIG. 2 PRIOR ART
FIG. 2 is a partly cut-away side elevation of the blank of FIG. 1.

Considering first the prior art and looking at FIGS. 1, 2 an 3 in particular, one can see that a cap blank comprises a slightly domed roof 12 with a downwardly extending skirt 13, of which the peripheral margin is outwardly flared and comprises a plurality of equally spaced apart ribs 14 and intermediate non-ribbed portions 15.

A conventional gasket 16 may be applied to the under-side of the roof 12.

Figure 3:
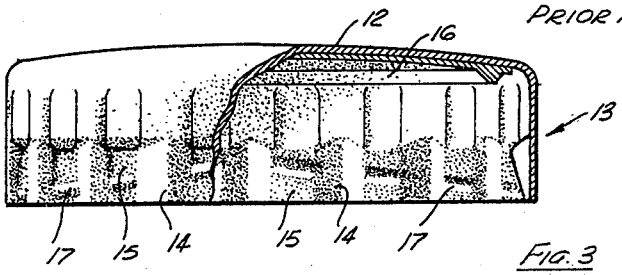
FIG. 3 PRIOR ART
FIG. 3 is a view similar to FIG. 1 but showing the cap after it has been applied to a bottle by a closure forming tool.

When the blank of FIG. 2 is applied to the top of a bottle and a cylindrical closure forming tool brought down upon it, it is changed into the cap of FIG. 3 wherein the corresponding skirt portions bear the same reference numerals as in FIG. 2. It will be seen that the ribs 14 are straightened so as to extend vertically downwardly whereas the portions 15 are forced underneath the bead rimming the bottle pouring opening (not shown). FIG. 3 shows the grooves 17 formed in the intermediate portions 15 by the thread formation normally provided on the bottle finish when a screw-off type seal is required.

Figure 8:
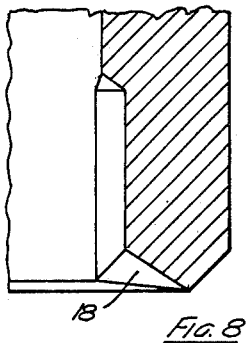
FIG. 8 PRIOR ART
FIG. 8 is a view taken on line 8—8 of FIG. 7.
Figure 7:
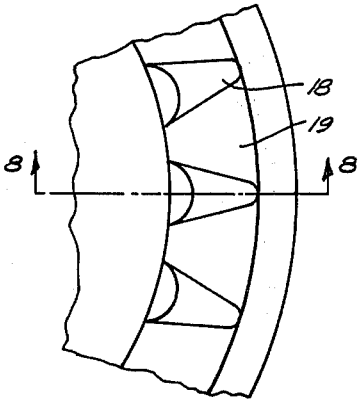
FIG. 7 PRIOR ART
FIG. 7 is a view from below of a peripheral portion of a female die used in the manufacture of the prior art blank of FIG. 1.

The shaping and nature of the ribs 14 may perhaps be better appreciated by reference to FIGS. 7 and 8 which shows the female die in which the blank was originally shaped and with which it conforms. It will be seen that the ribs 14 would conform to the shape of the die recesses 18 so that each rib is relatively narrow at its free end whereas the portions 15 in the blank are broad conforming with the spaces 19 in the die intermediate the recesses 18.

Figure 4:
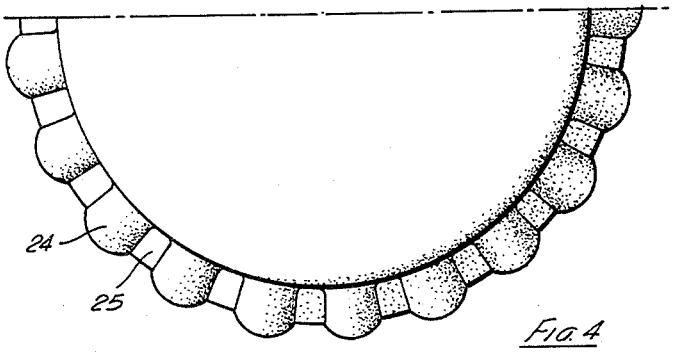
FIGS. 4, 5 and 6 are similar to FIGS. 1, 2 and 3 respectively but showing a blank and cap in accordance with the invention.
Figure 5:
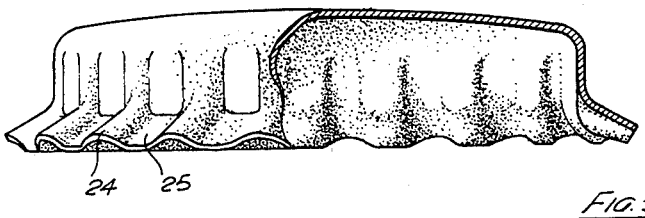
Figure 6:
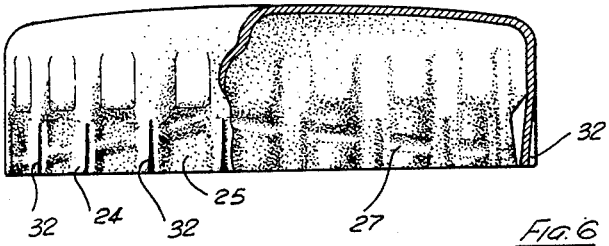
Figure 10:
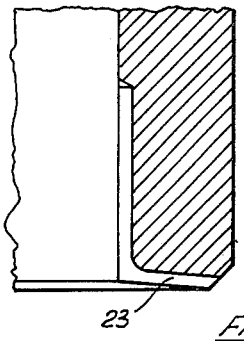
FIGS. 9 and 10 are similar to FIGS. 7 and 8 respectively but showing the die used in the manufacture of blank of FIG. 4.
Figure 9:
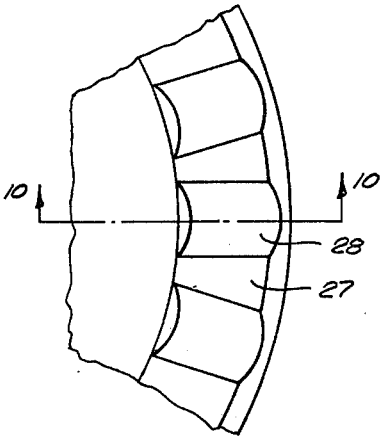

The blank of FIGS. 4 and 5, the formed cap of FIG. 6 and the die of FIGS. 9 and 10 conform to crown seal blanks of the present invention and it will be seen that ribs 24 corresponding to ribs 14 of the prior art are relatively shallow throughout and appreciably broader at their peripheral edge than are ribs 14. For descriptive convenience the integers appearing in FIGS. 4, 5, 6, 9 and 10 have reference numerals corresponding to those of the corresponding integers of the prior art drawings but with the prefix 2 instead of the prefix 1.

Figure 11:
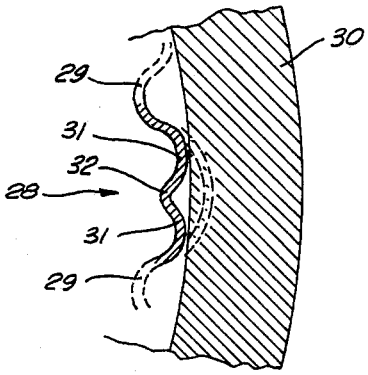
FIG. 11 is an enlarged view from below of a peripheral portion of a cap in accordance with FIG. 6 showing a seal forming tool in association therewith.

Because of their peripheral length the ribs 29 collapse or buckle inwardly near their periphery as the forming tool 30 (see FIG. 11) descends so that at the lower periphery of the finished cap each rib is bifurcated to some extent to display two protruding portions 31 separated by a depression 32. The depression 32 is of maximum width at the edge of the cap and decreases upwardly, the depressions 32 are indicated in FIG. 6 and as a result of their presence the finished skirt of the cap is appreciably more comfortable to grip. The depressions 32 are formed quite evenly and regularly and their existence in a finished seal cap is a sure indication that the cap originally was shaped in accordance with a blank according to the invention.

I claim:

1. A crown seal cap blank of the kind comprising a central roof portion and a downwardly extending skirt with an outwardly flared and ribbed peripheral edge portion wherein each rib of the peripheral skirt portion is of substantially the same breadth throughout its length, and wherein the breadth of a rib is greater than the distance separating adjacent ribs, whereby upon application to close a bottle the peripheral edge of each rib crumples to provide a central depression in the rib.

2. A crown seal blank according to claim 1 wherein each rib of the peripheral skirt portion is of substantially the same depth throughout its length.

3. A crown seal closure, when placed in operative sealing engagement with a container, comprising: a central roof portion; a downwardly extending skirt including a corrugated peripheral edge portion and wherein the crest of each corrugation is crumpled in a radially inwardly direction to constitute an inwardly directed depression bifurcating the crest of each corrugation.

* * * * *